United States Patent [19]

Lee

[11] Patent Number: 5,049,788

[45] Date of Patent: Sep. 17, 1991

[54] LIGHTING DEVICE OF FLUORESCENT LAMP

[76] Inventor: Sang-Woo Lee, 187-90 Yeonhee-Dong, Seodaemoon-Ku, Seoul, Rep. of Korea

[21] Appl. No.: 516,727

[22] Filed: Apr. 30, 1990

[30] Foreign Application Priority Data

Jan. 19, 1990 [KR] Rep. of Korea ..... 564

[51] Int. Cl.[5] ..... H05B 37/02

[52] U.S. Cl. ..... 315/219; 315/244; 315/DIG. 5; 315/DIG. 7; 331/113 A; 363/22; 363/132

[58] Field of Search ..... 315/219, 209 R, DIG. 7, 315/DIG. 5; 331/113 A; 363/131, 132

[56] References Cited

U.S. PATENT DOCUMENTS 4,319,316 3/1982 Farrer et al. ..... 363/132
4,553,070 11/1985 Sairanen et al. ..... 315/209 R
4,581,562 4/1988 Nilssen ..... 315/219
4,722,040 1/1988 Ball ..... 315/DIG. 7
4,912,374 3/1990 Nagase et al. ..... 315/DIG. 5

FOREIGN PATENT DOCUMENTS 2071945 9/1981 United Kingdom ..... 363/132

*Primary Examiner*—Eugene R. LaRoche
*Assistant Examiner*—Son Dinh
*Attorney, Agent, or Firm*—Jones, Tullar & Cooper

[57] ABSTRACT

A lighting circuit for a fluorescent lamp includes a D.C. power supply which is connected across a pair of series transistors. A transformer has first and second windings connected to the bases of respective transistors and a third winding connected between the junction of the transistor pair and a booster transformer. The filaments of the fluorescent lamp are connected through a choke coil to the booster transformer, and a capacitor is connected in resonant circuit with the choke coil.

4 Claims, 2 Drawing Sheets

LIGHTING DEVICE OF FLUORESCENT LAMP

BACKGROUND OF THE INVENTION

This invention relates to a cathode-preheated discharge tube lighting device such as a fluorescent lamp, and particularly to a high power factor and low-current lighting device.

For lighting a fluorescent lamp when the normal power source is 100 V, the voltage should be increased. Therefore, a conventional voltage multiplying rectifier, as shown in FIG. 1, is used as power supply input. The voltage multiplying rectifier comprises condensers $EC_1$, $EC_2$ and diodes $D_1$, $D_2$.

With this conventional voltage multiplying rectifier, however a phase difference between the voltage and current of the normal power source is produced by the capacitors $EC_1$, $EC_2$ in the process of rectification, thereby lowering the power factor by 60% and less. Accordingly, compensation of the phase difference is required. For this compensation, a phase equalizer comprising a low-frequency coil $L_1$ and a condenser CO should be installed in the power source. However, the low-frequency coil $L_1$ has disadvantages, in that it produces hum due to magnetic field resonance, and tend to overheat so that a great loss of power is caused.

SUMMARY OF THE INVENTION

An object of the present invention is to provide a lighting circuit for a fluorescent lamp, wherein a phase difference is not generated by the capacitors $EC_1$, $EC_2$. This is accomplished by avoiding voltage-multiplying rectification while allowing only rectification in the input power source. As a consequence, the low-frequency coil $L_1$ for phase-compensation is not required, thus preventing the generation of hum and overheating.

Another object of the present invention is to provide a lighting circuit for a fluorescent lamp wherein an induction winding $N_1$ at one end thereof is connected to the connecting point between a pair of transistors $Q_1$, $Q_2$ which are alternatively on and off. The other end of the induction winding $N_1$ is connected through a transformer and the inductor CH to fluorescent lamp, the connecting point being an input of the fluorescent lamp.

BRIEF DESCRIPTION OF THE DRAWINGS

The foregoing objects, features and advantages of the present invention will become apparent to those of skill in the art from a consideration of the following detailed description of preferred embodiments thereof, taken with the accompanying drawings, in which.

DETAILED DESCRIPTION OF THE INVENTION

Figure 1:
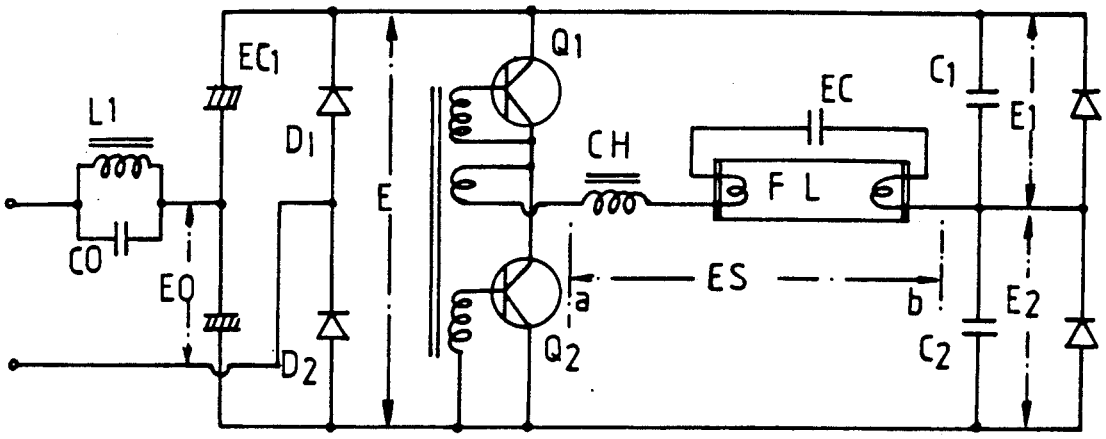
FIG. 1 is a circuit diagram of a conventional lighting device.
Figure 2:
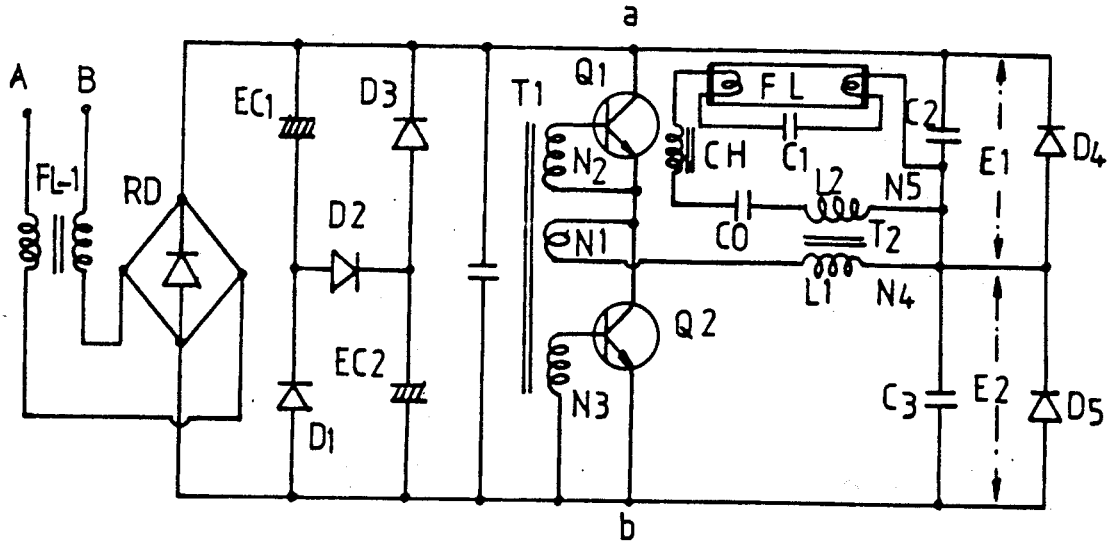
FIG. 2 is a circuit diagram of a lighting circuit in accordance with the present invention.

Referring to the drawings, particularly to FIG. 2, a 100 V AC power source applied between power source inputs A B is rectified by means of a bridge rectifier diode RD after noise is filtered by a noise filter FL-1. The ripple current produced in the process of rectification by the diode RD is further re-rectified by capacitors $EC_1$, $EC_2$ and diodes $D_1$, $D_2$, $D_3$ and then used as an applied power source at a b. This rectifier circuit is conventional and not particular as a source of direct-current power for a lighting circuit for a fluorescent lamp.

Two transistors $Q_1$, $Q_2$ are connected in an emitter-collector series circuit with each other across the direct-current power source a b, the transistors being driven alternatively on and off by a transformer $T_1$ which includes secondary windings $N_2$, $N_3$ connected in the emitter-base circuits of the two transistors $Q_1$ and $Q_2$, respectively. The windings $N_2$ and $N_3$ have opposite polarity to each other, A primary winding $N_1$ is also wound on $T_1$ for operating the driving circuit of an inverter. A circuit comprising a choke CH, condensers $C_1$, $C_2$, $C_3$ and diodes $D_4$, $D_5$ is installed in the output of the primary winding $N_1$ of transformer $T_1$. A booster transformer $T_2$ is connected between the output of the primary winding $N_1$ and the choke CH. The transformer $T_2$ has one end of a primary winding $L_1$ thereof connected to the primary winding $N_1$ of the transformer $T_1$, and the other end of the primary winding $L_1$ is connected to the center point between capacitors $C_2$ and $C_3$ which are connected in series with each other between direct-current power sources a, b, thereof, constructing a first circuit. A series resonant circuit comprising capacitors $C_0$, $C_1$ and choke CH is connected across both ends of a secondary coil $L_2$ of the booster transformer $T_2$, the condenser $C_1$ having both ends thereof connected to corresponding ends of the filaments of the fluorescent lamp.

When the alternating current power source is ON, this invention applies a DC voltage, close to the value of power source voltage, to both ends of transistors $Q_1$, $Q_2$. At the same time said transistors $Q_1$, $Q_2$ alternately initiate their ON or OFF driving acting as an inverter with a fixed repetition rate set by transformer $T_1$. When this occurs a voltage that is equivalent to the value of the power source voltage is applied to the primary coil $L_1$ of the booster transformer $T_2$.

A voltage $E_2$ is induced across the ends of secondary coil $L_2$ of booster transformer $T_2$. Because the voltage induced to the secondary coil $L_2$ is set by the ratio of the winding number $N_4$ of primary coil $L_1$ and the winding number $N_5$ of secondary coil $L_2$; that is, $N_4:N_5=E_1:E_2$, the ratio of the winding number shall be chosen to fit the lighting characteristic the fluorescent lamp used.

Therefore, if an appropriate voltage is induced to the secondary coil $L_2$, both filaments of fluorescent lamp FL are preheated by the LC serial resonant circuit including the capacitors $C_0$, $C_1$ and choke CH, and resonant currents flow.

At that time the voltage generated at the secondary coil $L_2$ applies the voltage needed to initiate lighting across capacitor $C_1$ so that the fluorescent lamp FL lights.

The other characteristic of this invention is the role played by the choke coil CH, which controls over-currents and amends the wave pattern of said over-currents to maintain a wave pattern with a low crest factor by forming resonant circuit with capacitor $C_0$.

Figure 3:
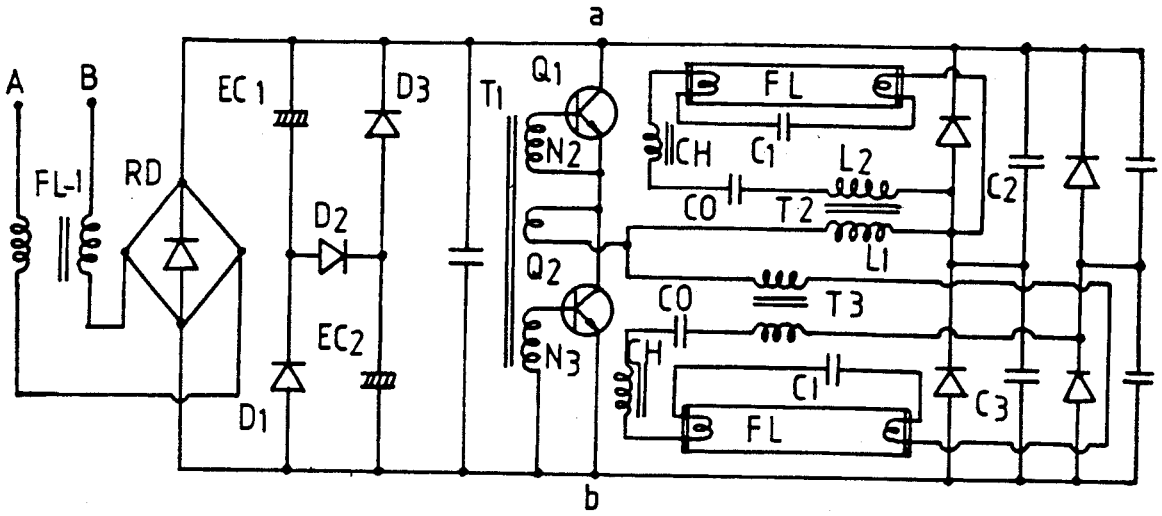
FIG. 3 is a circuit diagram showing lighting state of a plurality of lamps.

Also this the circuit of this invention can light a plurality of lamps by connecting a plurality of transformers $T_2$, $T_3$ and the resonant circuit including of capacitors $C_0$, $C_1$ and choke CH to the output of primary winding $N_1$ as shown FIG. 3.

What is claimed is:

1. A lighting circuit for a fluorescent lamp, comprising:

a d.c. power supply;

first and second transistors connected in series across said power supply, said transistors being connected to each other at a first connection point;

a transformer having first and second windings connected to said first and second transistors, respectively, for switching said transistors;

a third winding on said transformer, said third winding being connected at a first end to said first connection point and at a second end through a primary winding of a booster transformer to a second connection point;

a fluorescent lamp having a first filament connected to said second connection point and a second filament connected through a choke coil and to a secondary winding on said booster transformer; and a first capacitor connected across said first and second filaments and forming a resonant circuit with said choke coil.

2. The lighting circuit of claim 1, wherein said second connection point is located at the junction of second and third capacitors connected in series across said d.c. power supply.

3. The lighting circuit of claim 2, wherein said second connection point is located at the junction of first and second diodes connected in series across said d.c. power supply.

4. The lighting circuit of claim 3 further including: a plurality of booster transformers having primary windings connected to said third winding; and a plurality of fluorescent lamps, each lamp being connected to a secondary winding of a corresponding booster transformer.

* * * * *